US005254024A

United States Patent [19]

Kobayashi et al.

[11] Patent Number: 5,254,024

[45] Date of Patent: Oct. 19, 1993

[54] ROTATABLE JET PROPULSION UNIT FOR WATERCRAFT

[75] Inventors: Noboru Kobayashi; Hirofumi Imaeda, both of Iwata, Japan

[73] Assignee: Yamaha Hatsudoki Kabushiki Kaisha, Iwata, Japan

[21] Appl. No.: 723,831

[22] Filed: Jul. 1, 1991

[30] Foreign Application Priority Data

Jun. 20, 1990 [JP] Japan ..... 2-163412

[51] Int. Cl.[5] ..... B63H 11/113

[52] U.S. Cl. ..... 440/42; 440/38

[58] Field of Search ..... 440/38, 40–43, 440/58–60, 83, 61; 60/221, 222

[56] References Cited

U.S. PATENT DOCUMENTS 2,961,988 11/1960 Wood ..... 440/83 X
3,073,277 1/1963 Lee ..... 60/221
3,282,240 11/1966 Pipes ..... 440/58 X
3,357,393 12/1967 Urbassik ..... 440/61

FOREIGN PATENT DOCUMENTS 386760 9/1990 European Pat. Off. ..... 440/40
2732671 1/1979 Fed. Rep. of Germany ..... 440/38
2032871 5/1980 United Kingdom ..... 440/38

*Primary Examiner*—Sherman Basinger
*Attorney, Agent, or Firm*—Ernest A. Beutler

[57] ABSTRACT

A jet propulsion unit for powering a watercraft that is contained within a tunnel on the underside of the hull of the watercraft. The jet propulsion unit is rotatable about a longitudinally extending axis to rotate its water inlet opening from a downwardly facing position to a raised, out of the water storage and service position The drive for rotating the jet propulsion unit is positioned forwardly of the tunnel and out of the body of water in which the watercraft is operating.

15 Claims, 4 Drawing Sheets

ROTATABLE JET PROPULSION UNIT FOR WATERCRAFT

BACKGROUND OF THE INVENTION

This invention relates to a rotatable jet propulsion for a watercraft and more particularly to an improved arrangement for permitting servicing of a jet propulsion unit contained in a tunnel beneath the hull of a watercraft.

The use of jet propulsion units for powering watercraft is well known as are the advantages of such units. One of the advantages of jet propelled watercraft is that they are able to operate in extremely shallow bodies of water. However, because of their shallow water operation, jet propulsion units frequently may ingest foreign material into the impeller that requires removal for servicing. In addition, it is desirable to be able to position the jet propulsion unit, when not be employed to propel the watercraft, in an out of the water position to prevent encrustation and formation of barnacles or the like on the water inlet passages of the jet propulsion unit.

A wide variety of arrangements have recently been proposed for permitting movement of the jet propulsion unit from its normal propulsion system to a raised out of the water position. When the jet propulsion unit is positioned in a tunnel beneath the hull of a watercraft, it is particularly important to insure that the jet propulsion unit is fully elevated when it is not being utilized to propel the watercraft. Prior art systems have employed arrangements which not only rotate the jet propulsion unit, but which also tilt it so as to achieve this result. However, such compound movements are, obviously, somewhat complicated.

It is, therefore, a principal object of this invention to provide an improved and simplified jet propulsion unit for a watercraft that may be conveniently moved from a propulsion position to an out of the water position.

It is a further object of this invention to provide a jet propulsion unit that is movable between its operative and storage positions by pure rotation about a longitudinal axis.

It is a further object of this invention to provide an improved arrangement for mounting a jet propulsion unit for rotation about a single axis so that it can be conveniently moved between its propulsion position and an out of the water position.

As has been previously noted, when jet propulsion units are employed for watercraft, it is convenient to position them in a tunnel beneath the hull of the watercraft. Also, the advantages of providing movable support for the jet propulsion unit so that it may be moved out of the water either for servicing or for storage purposes also been noted. The types of devices previously employed for effecting such movement have generally been positioned within the tunnel of the watercraft and hence are subjected to the water in which the watercraft is operating. This can give rise to obvious problems.

It is, therefore, a further object of this invention to provide a drive arrangement for operating a movably supported jet propulsion unit wherein the drive mechanism is positioned within the hull of the watercraft and not in contact with the body of water.

It is a further object of this invention to provide a remotely operated power arrangement for moving a jet propulsion unit between a propulsion position and an out of the water position and wherein the power device is not disposed in the body of water in which the watercraft is positioned.

SUMMARY OF THE INVENTION

A first feature of this invention is adapted to be embodied in a jet propelled watercraft that is comprised of a hull defining a tunnel in an underside thereof. A jet propulsion unit is employed that is comprised of a water inlet portion having a water inlet opening, an impeller portion receiving an impeller rotatable about a first axis for drawing water through the water inlet opening, and a discharge portion for discharging water moved by the impeller generally rearwardly to effect a propulsion force. Means are provided for mounting the jet propulsion unit in the tunnel for rotation of at least the water inlet portion about a second axis from a downwardly facing propulsion position to an upwardly facing service position. The second axis extends substantially horizontally and is positioned above the first axis when the unit is in the propulsion position.

Another feature of the invention is adapted to be embodied in a jet propelled watercraft comprised of a hull defining a tunnel in an underside thereof. A jet propulsion unit is movably supported within the tunnel for movement between a normal propulsion position and a raised storage position In accordance with this feature of the invention, power means are provided externally of the tunnel and within the hull for moving the jet propulsion unit between its positions.

DETAILED DESCRIPTION OF THE PREFERRED EMBODIMENT OF THE INVENTION

Figure 1:
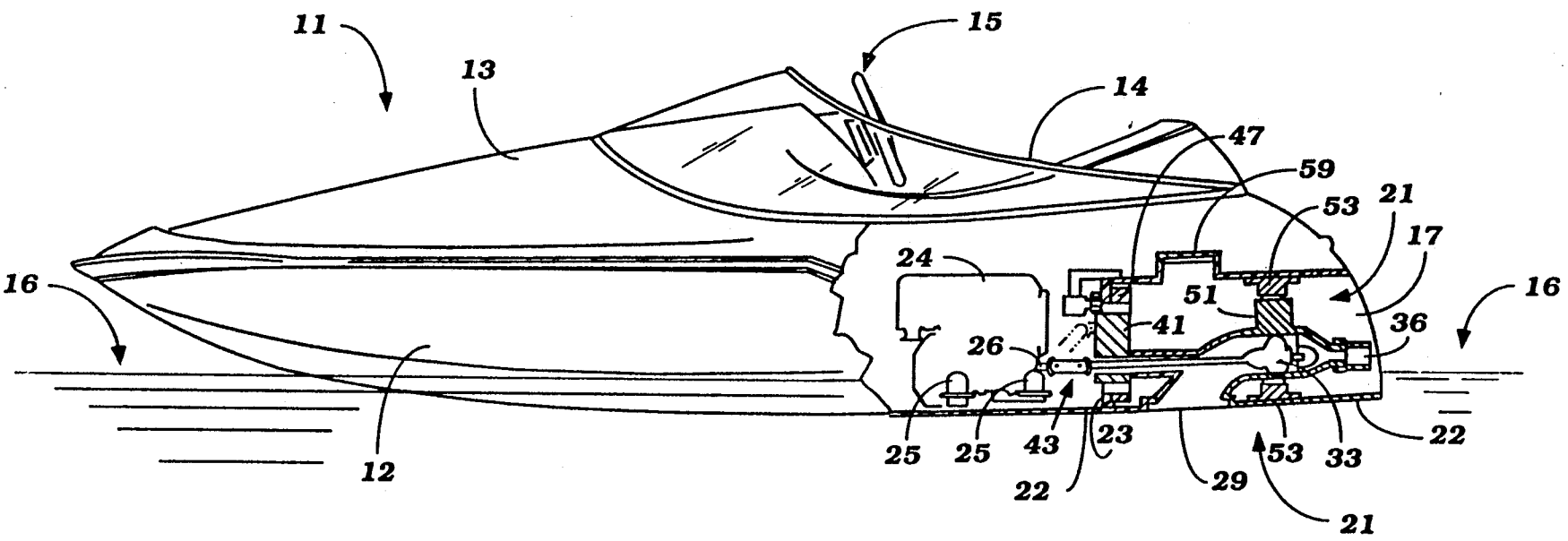
FIG. 1 is a side elevational view of a watercraft constructed in accordance with an embodiment of the invention, with a portion broken away so as to more clearly show the propulsion system.

Referring first in detail to FIG. 1, a watercraft embodying the invention is identified generally by the reference numeral 11. The watercraft 11 is comprised of a hull made of a lower portion 12 and a deck portion 13, which may be formed from any suitable material, such as fiberglass reinforced resin or the like and which are affixed to each other in a suitable manner. In the illustrated embodiment, the watercraft 11 has a rearwardly positioned passenger compartment 14 in which one or more seats are provided and which include a steering wheel 15 and other vehicular controls (not shown) so that an operator can operate the watercraft 11 in a well known manner. The watercraft 11 is designed to normally operate in a body of water, indicated generally at 16.

Figure 3:
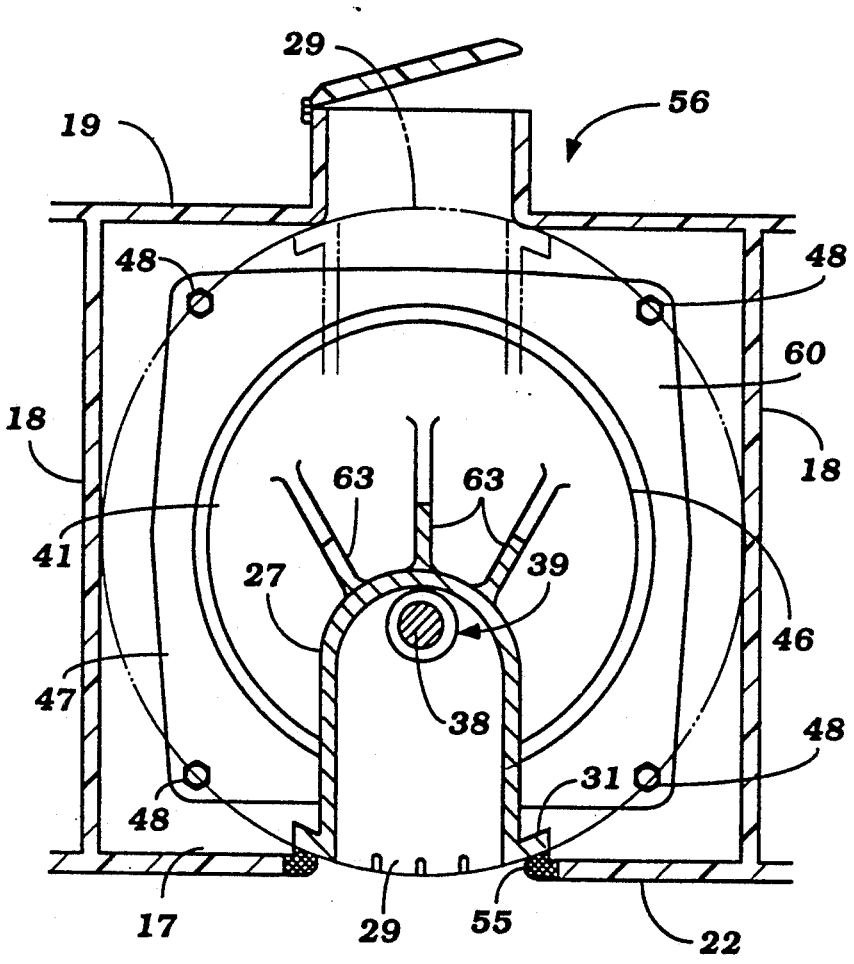
FIG. 3 is a further enlarged cross sectional view taken along the line 3—3 of FIG. 2.
Figure 4:
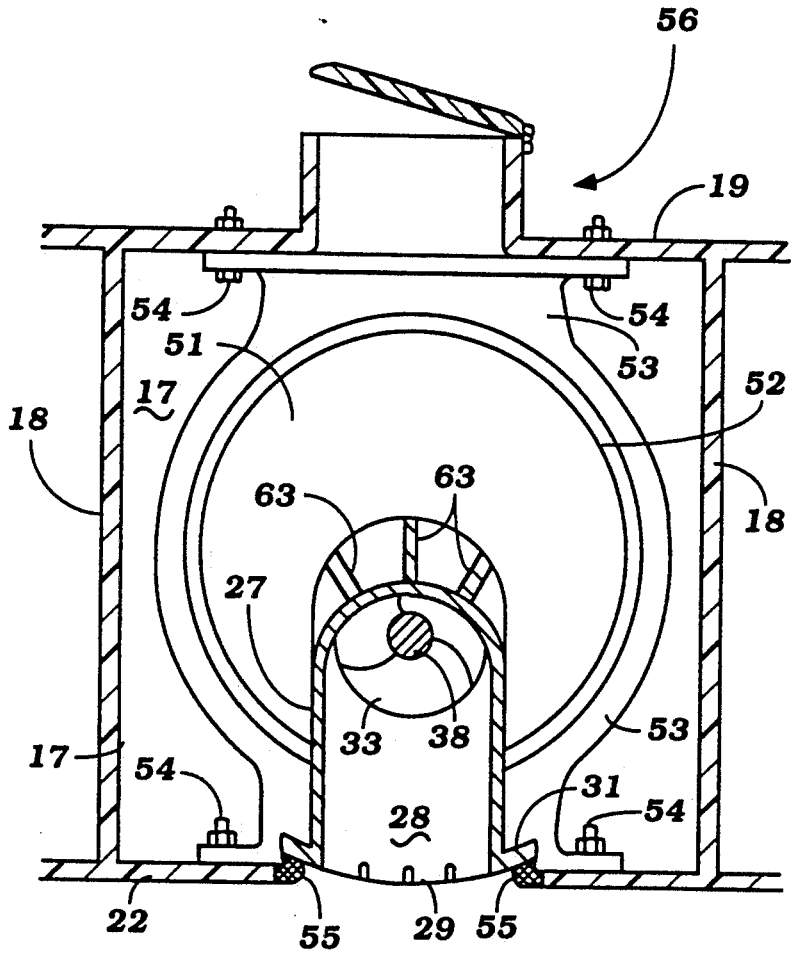
FIG. 4 is a further enlarged cross sectional view taken along the line 4—4 of FIG. 2.

At the rear end of the watercraft and specifically beneath the passenger compartment 14, there is provided a tunnel area 17 which is defined by a pair of upwardly extending sidewalls 18 and a top wall 19 (FIGS. 3 and 4). A jet propulsion unit, having a construction to be described and identified generally by the reference numeral 21, is positioned in the tunnel 17 for propelling the watercraft in a manner to be described. The hull also has an under panel 22 that forms partially a closure for the lower surface of the tunnel 17.

Referring again to FIG. 1, the forward extremity of the tunnel 17 is defined by a vertically extending bulkhead 23 of the hull position 12 and an internal combustion engine 24 is positioned forwardly thereof. The engine 24 may be of any known type and is mounted forwardly of the bulkhead 23 on engine mounts 25. The engine 24 has an output shaft 26, which is coupled in a manner to be described, to the jet propulsion unit 21 for driving it.

Referring now primarily to the remaining figures, it will be seen that the jet propulsion unit 21 has an outer housing assembly that is comprised of a water inlet portion 27 which defines a water inlet passageway 28 that extends from a downwardly facing water inlet opening 29. The opening 29 is defined by an outstanding flange 31 which has a generally arcuate lower surface as best seen in FIGS. 3 and 4. This surface 31 is curved about an axis which will be described later.

An impeller housing portion 32 is formed rearwardly of the water inlet portion 28 and an impeller 33 is rotatably journaled therein by means of a bearing supported in a bearing block 34 which also includes straightening vanes. Water pumped by the impeller 33 is drawn through the inlet opening 29 and inlet 28 and then discharged rearwardly through a discharge nozzle 35. A steering nozzle 36 is pivotally supported in registry with the discharge nozzle 35 by means of pivot pins 37 for steering movement about a generally vertically extending steering axis. Steering of the discharge nozzle 36 is controlled by the steering wheel 15 in a well known manner.

The impeller 33 is affixed to an impeller shaft 38 which extends forwardly through the water inlet portion 28 and through a tubular extension 39 of the jet propulsion unit outer housing which extends toward the bulkhead 23 The forward end of the tubular extension 39 is fixed to a cylindrical section 41 which carries a bearing 42 for rotatably journaling the impeller shaft 38 for rotation about a first axis. The cylindrical section 41 has its axis disposed eccentrically to the rotational axis defined by the bearing 42, for a reason which will become apparent.

A joint 43 connects the engine output shaft 26 with the impeller shaft 38 and accommodates certain movement as will be described. The joint 43 includes a pair of U joints 44 and a splined connection 45 so as to permit relative rotation, angular movement and axial movement, as will be described.

The cylindrical end wall 41 of the jet propulsion unit housing is supported in a bearing assembly 46 for rotation about an axis that is coincident with the axis of the cylindrical end wall 41. The bearing assembly 46 is mounted in a bearing carrier 47 which is affixed to the bulkhead 23 by means of fasteners 48. A water tight seal 49 is positioned within the tunnel 17 and rearwardly of the bearings 46 so as to preclude forward water leakage from the tunnel through the bulkhead 23.

A similar bearing arrangement supports the jet propulsion unit at its rear end and specifically in proximity to the impeller housing portion 32 The impeller housing portion 32 is formed with an eccentric cylindrical section 51 which has its axis aligned with the axis of the end wall 41. A bearing assembly 52 journals this cylindrical portion 51 in a bearing block 53 which is affixed to the lower wall 22 of the tunnel 17 by fasteners 54. Like fasteners 54 also connect the upper portion of the bearing block 53 to the top wall 19 of the bulkhead assembly.

As a result of the aforedescribed construction, the jet propulsion unit 21 is rotatable about an axis defined by the cylindrical sections 41 and 51 which axis is offset upwardly from the normal drive position of the impeller shaft axis 38 and which extends generally through the center of the tunnel 17.

As has been previously noted, the flange 31 has a curved face and this center of curvature is coincident with the rotational axis of the jet propulsion unit 21. Accordingly, the lower hull portion 22 is formed with an opening that is surrounded by a gasket 55 which is sealingly engaged with the flange 31 when the flange 31 is in its downwardly facing position so that no water leakage will be precluded around the inlet opening 29 of the jet propulsion unit.

However, the jet propulsion unit 21 may be rotated from the downwardly facing position in which it normally drives to an upwardly facing position wherein the inlet opening 29 will be out of the body of water in which the watercraft is operating. In this condition and as shown in the phantom line view of FIG. 3, the inlet opening 29 will be juxtaposed to a service opening 56 formed in the upper wall 19 and which may be opened so as to permit occupants of the watercraft to reach into the inlet opening 29 and clear foreign material from it. Because of the fact that the axis of rotation of the jet propulsion unit 21 is eccentrically disposed from the impeller axis 38, there can be a substantial lift of the jet propulsion unit inlet 29 without significant displacement of the axis of the impeller shaft 38. As may be seen in the phantom line view of FIG. 2, the connection 43 accommodates this rotary motion through flexure of the universal joints 44 and expansion and contraction of the splined connection 45. Because of the raised position of the water inlet opening 29, it is also possible to insure that no water will remain in the inlet opening when the watercraft is not being operated and hence, encrustation will be precluded.

An arrangement is provided for rotating the jet propulsion unit 21 between its described positions and in accordance with an important feature of this invention, the rotational mechanism is disposed forwardly of the bulkhead 23 and outside of the tunnel 17. Because of this, the rotational drive mechanism need not be waterproof.

Figure 2:
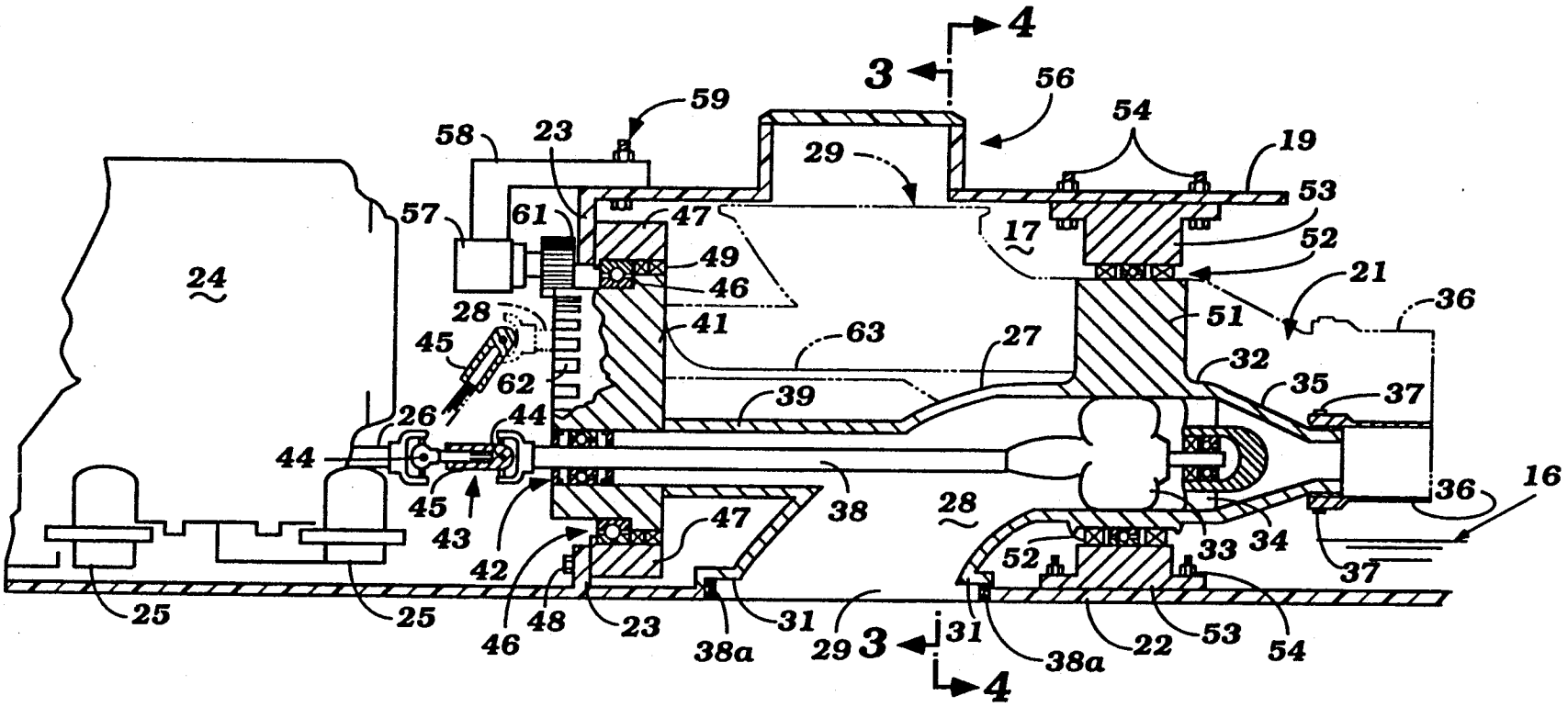
FIG. 2 is an enlarged view of the broken away portion of FIG. 1.

Referring to FIG. 2, this rotational mechanism includes an electric motor 57 that is mounted on a mounting bracket 58 that is affixed to the upper wall 19 by fasteners 59. The electric motor 57 is controlled by an appropriate switch and drives a pinion gear 61 that is enmeshed with a ring gear 62 formed integrally on the forward portion of the cylindrical wall member 41 of the jet propulsion unit housing. As a result, operation of the motor 57 will cause the entire jet propulsion unit to rotate between the aforedescribed positions.

For stiffening purposes and if desired, stiffening ribs 63 may be formed on the outer periphery of the jet propulsion unit housing. These ribs appear in FIGS. 2 through 4.

It should be readily apparent from the foregoing description that the described construction is very effective in permitting the rotation of a jet propulsion unit between a normal operating position and a raised out of the water storage and service position. This can be done only through rotary movement and this rotary movement is accomplished in such a way so as to permit a substantial amount of lifting of the jet propulsion unit without having the impeller shaft move through a substantial distance. Of course, the foregoing description is only that of a preferred embodiment of the invention. Various changes and modifications may be made without departing from the spirit and scope of the invention as defined by the appended claims.

We claim:

1. A jet propelled watercraft comprised of a hull, a jet propulsion unit comprised of a water inlet portion having a water inlet opening, an impeller portion receiving an impeller rotatable about a first axis extending longitudinally or said hull for drawing water through said water inlet opening and a discharge portion for discharging water moved by said impeller generally rearwardly to effect a propulsion force, and supporting means for supporting said jet propulsion unit upon said hull for rotation of at least said water inlet portion about a second axis form a downwardly facing propulsion position, said second axis extending substantially longitudinally relative to said hull and being offset form said first axis and above said first axis when said jet propulsion unit is in its downwardly facing position.

2. A jet propelled watercraft as set forth in claim 1 wherein the entire jet propulsion unit is rotatable about the second axis between its positions.

3. A jet propelled watercraft as set forth in claim 2 wherein the supporting means supports the jet propulsion unit at its forward and rear ends.

4. A jet propelled watercraft as set forth in claim 1 wherein the hull defines a tunnel in an underside thereof and the jet propulsion unit is mounted at least in part within the tunnel.

5. A jet propelled watercraft as set forth in claim 4 further including a joint between a propulsion means in the hull forwardly of the tunnel and the impeller for accommodating rotary motion of the jet propulsion unit water inlet opening.

6. A jet propelled watercraft as set forth in claim 5 wherein the joint is comprised of a pair of spaced apart universal joints and a splined connection.

7. A jet propelled watercraft as set forth in claim 4 wherein the hull defines a service opening in communication with the tunnel and through which the inlet opening may be accessed when in its second position.

8. A jet propelled watercraft as set forth in claim 7 further including drive means for rotating said jet propulsion unit water inlet portion about the second axis, said drive means being positioned forwardly and out of the tunnel.

9. A jet propelled watercraft as set forth in claim 8 further including propulsion means positioned within the hull forwardly of the tunnel for driving the impeller.

10. A jet propelled watercraft as set forth in claim 9 further including a joint between the propulsion means and the impeller for accommodating rotary motion of the jet propulsion unit water inlet opening about the second axis.

11. A jet propelled watercraft as set forth in claim 10 wherein the joint is comprised of a pair of spaced apart universal joints and a splined connection.

12. A jet propelled watercraft as set forth in claim 8 wherein the drive means further includes intermeshing gears for rotating the jet propulsion unit water inlet portion.

13. A jet propelled watercraft as set forth in claim 12 further including a joint between a propulsion means and the impeller for accommodating rotary motion of the jet propulsion unit about the second longitudinally extending axis.

14. A jet propelled watercraft comprised of a hull defining a bulkhead, a tunnel formed on the underside of said hull and bounded at its front by said bulkhead, a jet propulsion unit having an impeller, supporting means for supporting said jet propulsion unit at least in part within said tunnel on the rear side of said bulkhead for rotary movement about an axis extending longitudinally of said hull between a normal propulsion position and a displaced position, propulsion means positioned forwardly of said bulkhead and driving said jet propulsion unit, motor means positioned forward of said bulkhead, and transmission means positioned entirely forwardly of said bulkhead for connecting said motor means to said jet propulsion unit for rotating said jet propulsion unit between its position.

15. A jet propelled watercraft as set forth in claim 14 wherein the supporting means supports the jet propulsion unit at its forward and rear ends.

* * * * *